US009567993B2

(12) United States Patent
Bach et al.

(10) Patent No.: US 9,567,993 B2
(45) Date of Patent: Feb. 14, 2017

(54) SYSTEM AND METHOD FOR HOLDING TUBING FOR A PERISTALTIC PUMP

(71) Applicants: David T. Bach, Manchester, NH (US); James J. Bach, Manchester, NH (US)

(72) Inventors: David T. Bach, Manchester, NH (US); James J. Bach, Manchester, NH (US)

( * ) Notice: Subject to any disclaimer, the term of this patent is extended or adjusted under 35 U.S.C. 154(b) by 0 days.

(21) Appl. No.: 15/012,937

(22) Filed: Feb. 2, 2016

(65) Prior Publication Data

US 2016/0252085 A1 Sep. 1, 2016

Related U.S. Application Data

(63) Continuation-in-part of application No. 14/033,183, filed on Sep. 20, 2013, now Pat. No. 9,377,016, which is a continuation-in-part of application No. 13/114,266, filed on May 24, 2011, now abandoned.

(60) Provisional application No. 61/396,049, filed on May 24, 2010.

(51) Int. Cl.

| | |
|---|---|
| ***F04B 43/08*** | (2006.01) |
| ***F04B 43/12*** | (2006.01) |
| ***F04B 51/00*** | (2006.01) |

(52) U.S. Cl.

CPC ..... *F04B 43/1261* (2013.01); *F04B 43/1253* (2013.01); *F04B 43/1292* (2013.01); *F04B 51/00* (2013.01); *F04B 43/1215* (2013.01)

(58) Field of Classification Search

CPC ..... F04B 43/1253; F04B 43/1215; F04B 43/0072

USPC ..... 417/476, 477.1, 477.13

See application file for complete search history.

(56) References Cited

U.S. PATENT DOCUMENTS

| | | | | |
|---|---|---|---|---|
| 1,848,024 | A | 3/1932 | Owen | 417/477.8 |
| 3,140,666 | A | 7/1964 | Currie | 417/477.11 |
| 3,172,367 | A | 3/1965 | Kling | 417/475 |
| 3,353,491 | A | 11/1967 | Bastian | 417/477.9 |
| 3,402,673 | A | 9/1968 | Ballentine et al. | 417/477.1 |
| 4,181,476 | A | 1/1980 | Malbec | 417/477.3 |
| 6,406,267 | B1 | 6/2002 | Mondiere | 417/53 |
| 7,513,757 | B2 | 4/2009 | Gibson et al. | |

*Primary Examiner* — Peter J Bertheaud

(74) *Attorney, Agent, or Firm* — Clifford H. Kraft

(57) ABSTRACT

A system and method for holding tubing for a peristaltic pump that allows for tube stretch or deformation. The present invention compensates for tube stretching and holds the tubing in the elongated position using a one way bearing clutch. Drip retention or a reversal of the pump does not allow the tube to move back into the pump. An encoder can monitor tube elongation and allow metering the tubing during indexing.

5 Claims, 9 Drawing Sheets

Prior Art

Prior Art

Prior Art

Prior Art

SYSTEM AND METHOD FOR HOLDING TUBING FOR A PERISTALTIC PUMP

This is a continuation-in-part of application Ser. No. 14/033,183 filed Sep. 20, 2013 which was a continuation in part of application Ser. No. 13/114,266 filed May 24, 2011 which claimed priority from U.S. Provisional Patent Application No. 61/396,049 filed May 24, 2010. Applications Ser. Nos. 14/033,183, 13/114,266 and 61/396,049 are hereby incorporated by reference in their entireties.

BACKGROUND

Field of the Invention

The present invention relates generally to peristaltic pumps and more particular to a system and method for holding tubing for a peristaltic pump that enables each tubing to stretch and then holding of the tubes due to peristaltic tube elongation. The present invention compensates for tube stretching and improves dispensing accuracy.

Description of the Prior Art

Fluid dispensing in the pharmaceutical and other markets such as biotechnology are moving away from positive piston pumps and moving to peristaltic pump systems. The main driving force is that peristaltic pump systems do not create shear in the fluid being pumped, and the cleaning validation is simplified as compared to positive piston displacement systems. In seal-less positive displacement pumps, it has been demonstrated that the dispensing fluid experiences shear forces that have an adverse effect on delicate cell structures. Peristaltic pumps, on the other hand, use a series of rollers to compress tubing that passes through the pump to move a fluid. There are many companies that make peristaltic pumps such as Watson Marlow and Cole Parmer which use the same principle of compressing tubing to advance fluid. It has been demonstrated in numerous studies that the use of a peristaltic pump allows for the effective handling of protein and cell structures without the shear forces of piston pumps. Peristaltic pumps have a fluid path only consisting of the tubing that can easily be sterilized, and in many cases discarded after use. This makes the cleaning validation much simpler and reliable.

As peristaltic pumps are being used more for various products, there is a need to carefully support and control the tubing that is being used in the pump. Peristaltic pump tubing needs to be held at the input to the peristaltic pump so that when the tubing is compressed it does not advance into the pump. Some manufacturers such as Watson-Marlow, Cole-Parmer and others use tubing clamps or a Y structure that the tubing must be carefully inserted into and around two fixed posts, one post being at the input and the other at the output. When a tube is used in many peristaltic pumps, the closure mechanism is a pressure shoe that presses onto the tubing; the mechanism stretches the tubing. All tube holding mechanisms can have a negative effect of restricting the flow due to holding the tube too tight.

There are a number of attachment devices known in the art designed to secure and hold tubing, but none of the systems provides for tubing elongation when the peristaltic pump is exercised, and then holding the tube. Action of the pump can force the tubing to elongate in the direction of rotation. This can be seen in the field where the Y is stretched tightly around the two fixed posts before running; but after running, the tubing is loose at the output post showing it was stretched. If individual tube holders are used, the output clamp will exhibit a loose-tube condition present as the tube stretches during use. In some units such as the Colanar peristaltic pump FSP-1001, the rollers are geared so that the forward stretching is less than in non-geared systems, nevertheless elongation still takes place. Tubing stretch occurs in all peristaltic pump systems, and none of the systems currently known in the art have a way of compensating for this stretch. Many of the systems offer a drip retention or suck-back feature where the rollers in the pump are reversed at the end of a pump run in order to move the fluid back into the output tubing. In these cases, drip retention is part of the relaxing of the tube elongation and movement of fluid back into the tube. Tube stretching and relaxing leads to a loss of accuracy since it has the effect of causing variability in each fill.

The Watson Marlow Flexicon system, shown in figure four, has a method of holding the tubing in a peristaltic pump where the input side is held fixed, but there is no output restriction introduced into the fluid passage.

The Watson Marlow 505 type peristaltic pump uses a "Double-Y" set of peristaltic tubing that is secured in the pump by stretching the tubing set over a set of retention pegs. The distance is predetermined and if single tubes are used in the Watson Marlow 505, the nominal distance between tubing clamps is 145 mm for bore sizes up to 8.0 and 150 mm for 9.6 mm bore tubes. In most cases each peristaltic tube is held firmly at the input to the peristaltic pump and slightly stretched and secured with output clamps. Shown in FIG. 1 are Double-Y tubing sets from Watson Marlow that are inserted into the peristaltic pump. The pressure shoe is not shown.

When using Marprene tubing with the 505Di pump, the tubing must be readjusted: "after the first 30 minutes of running, re-tension the tube in the pump head by releasing the tube clamp on the delivery side a little and pulling the tube tight . This is to counteract the normal stretching that occurs with Marprene which can go unnoticed and result in poor tube life and accuracy degradation."

All manufacturers use some form of mechanical clamp to secure the input and output tube at fixed positions. In FIG. 2 is the Watson Marlow 314D pump head with adjustable clamps on both sides of the pump for the input and output tubes.

The Cole-Parmer Miniflex series of pumps also uses mechanical locks for their tube sets, but in each case lower tube holders are spring loaded vertically in place so they do not compensate for tube elongation. Refer to FIG. 3.

Gibson and Bannistar use a method of tube races to secure the tubing and assure that it stays aligned. U.S. Pat. No. 7,513,757 describes a different method of tube holding.

It would be advantageous to have a system and method where the tubing can elongate. The mechanism would minimally restrict the elongation, but will compensate, and in some cases, measure the elongation. The tubing is also held so that movements backwards or during a "drip retention" operation cannot take place due to one-direction bearings known at clutch bearings. If the tubing is small in nature, or does not provide the necessary tube stretching forces to advance through the tube holders, other forces such as a negator spring can be used to complete the tube holding.

SUMMARY OF THE INVENTION

The present invention works with both linear and rotary peristaltic pump configurations with any number of pump tube channels, tube sizes or number of peristaltic rollers in a given system. The input and output tube holding devices allow for tube elongation due to the peristaltic rollers. Located on two ⅛inch 316 series stainless steel shoulder screws are two roller clutches and two spacers to make up the assembly. Adjustments for tube size can be made by moving one of the tubing from the holders.

A particular embodiment of the present invention is a tube holding device for a peristaltic pump that allows for elongation of peristaltic pump tubing without letting the tubing move backward. The holder system includes a fame holding the peristaltic pump, a pair of substantially cylindrical rollers and roller gears mounted on the frame, the roller gears having longitudinal teeth or a sharp knurled surface and positioned to cooperate with the peristaltic pump tube between them. One or more of the rollers can be attached to a negator spring to assist in providing the necessary forces between the sharp knurled cylinders for small tubing. The rollers can optionally be concave to cause the tubing to center on them.

A particular embodiment of the present invention is a tube holding device for a peristaltic pump that allows for elongation of peristaltic pump tubing where the negator spring is replaced by a motor with torque that is adjustable.

Other configurations where the tubing is allowed to stretch, but is held in the stretched position, are within the scope of the present invention.

DESCRIPTION OF THE FIGURES

Illustrations are now presented to aid in understanding features of the present invention.

Several drawings and illustrations have been presented. The scope of the present invention is not limited to what is shown in the figures.

DESCRIPTION OF THE PREFERRED EMBODIMENTS

The present invention can be used with any linear or rotary peristaltic pump configuration with any number of pump tube channels, tube sizes or number of peristaltic rollers in a given system. The input and output tube holding devices allow for tube elongation due to the peristaltic rollers. Located on two ⅛inch, 316 should screws are two clutch rollers and two spacers for the assembly. The distance between the two rollers is adjusted allowing the tubing to elongate but not move backward toward the peristaltic rollers. The tubing is held in place until the operator opens and removes the tubing.

A particular embodiment of the present invention is a tube holding device for a peristaltic pump that allows for elongation of peristaltic tubing without letting the tubing move backward that includes a frame holding a peristaltic pump, a pair of substantially cylindrical rollers mounted on the frame, the rollers having longitudinal teeth or being sharp knurled, and positioned to cooperate with the peristaltic pump be clamping a peristaltic tube between them.

At least one of the rollers can be attached to a negator spring located in a string pot where the negator spring assists in providing force between the roller gears for small tubing. The negator spring can be replaced with a motor to assist in providing torque to tubes. The use of an encoder on an output roller or on the motor can allow the tube elongation time and subsequent weakening of the tube by continuous use to be measured.

The device can also have concave rollers with one or more concave locations each holding a pump tube to cause the pump tubing to center on the rollers.

Figure 1:
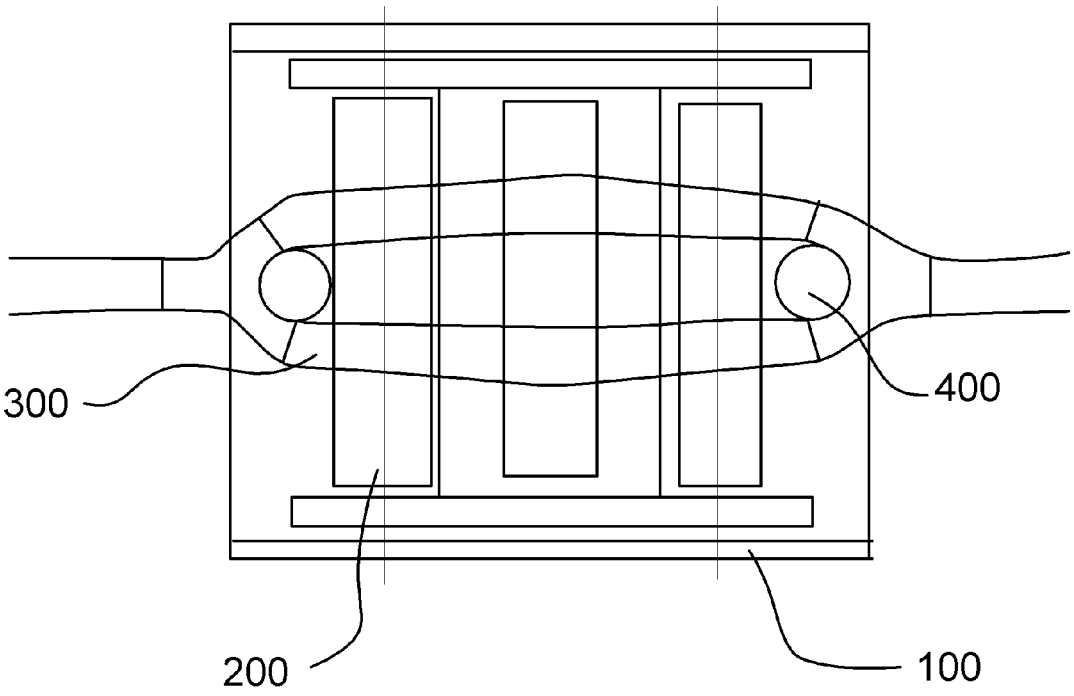
FIG. 1 shows a prior art peristaltic pump with Y tubing on fixed posts.

Turning to FIG. 1, a prior art peristaltic pump can be seen in a top down perspective view of a 505 L pump. The offset pressure shoes are not shown. The pump body 100 supports a series of peristaltic rollers 200 through which a "Y" tubing 300 is stretched over two fixed posts 400. The "Y" tubing is stretched on fixed posts that are 145 mm apart for tube sizes up to 8.0 and 150 mm for the 9.6 mm bore tubes. When using Marprene tubing in the pump the tubing must be readjusted after the first 30 minutes of running. This is to counteract the normal stretching that occurs with Marprene which can go unnoticed and result in poor tube life.

Figure 2:
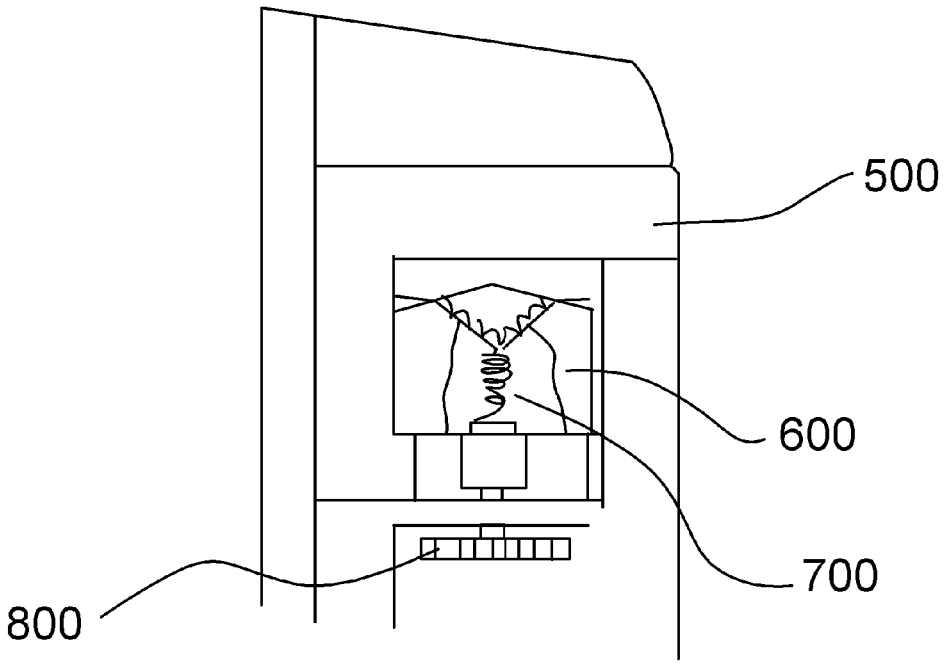
FIG. 2 shows the use of adjustable jaws used in a prior art Watson Marlow 314 pump.

FIG. 2, is a priori art Watson Marlow 314D pump head 500 with adjustable clamps 600 on both sides of the pump for the input and output tube. Each tube holder has an internal spring 700 and a thumb screw adjuster 800.

Figure 3:
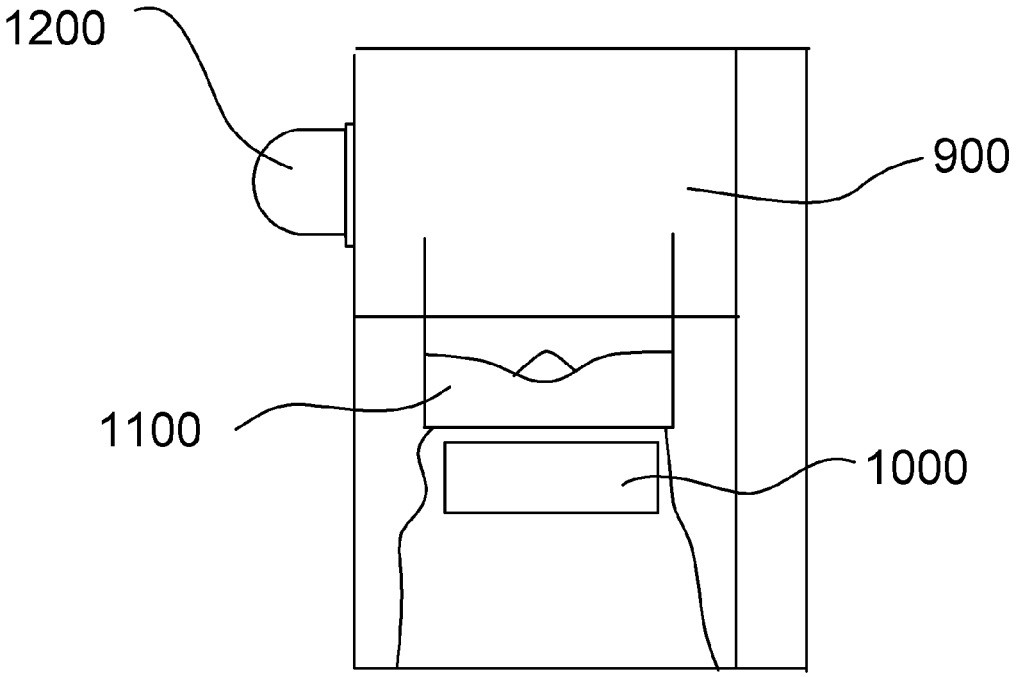
FIG. 3 shows the use of adjustable jaws used in prior art Cole Parmer pumps.

FIG. 3, is a prior art Cole Parmer Miniflex pump 900 with spring 1000 loaded tube holders 1100 that actuate on closing the pump by turning the front handle 1200.

Figure 4:
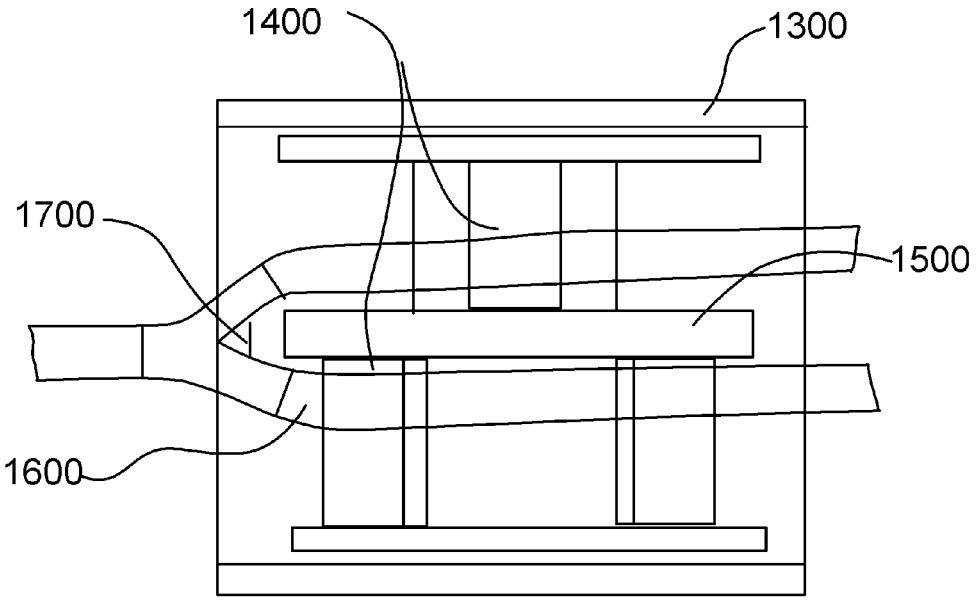
FIG. 4 shows the use of holding a tube using the prior art Watson Marlow Flexicon pump.

Shown in FIG. 4, is a prior art Watson Marlow Flexicon type of pump 1300 using offset rollers 1400 and a center tube barrier 1500. The tube 1600 is secured at the pump input over a fixed post 1700. The output tubes are free to elongate but are not held in the elongated position. The pressure shoe, not shown, is fixed and mounts over the tubes.

Figure 5:
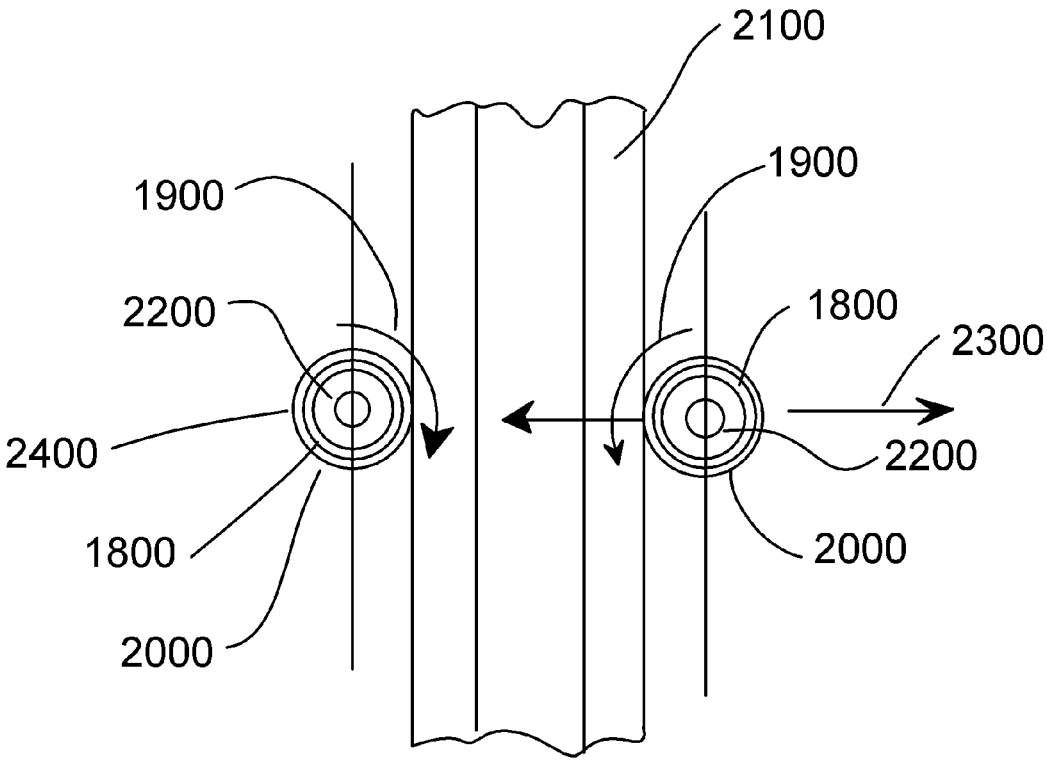
FIG. 5 shows an embodiment the present invention in a vertical orientation.

FIG. 5 depicts an embodiment of the present invention. At the input and output are two pairs of roller clutches 1800 that operate in the free direction as indicated by arrows 1900. Pressed over each roller clutch is a sharp knurled 2000 hard-coated aluminum tube. The plastic pump tubing 2100 is free to elongate but is held in place as the pair of roller clutches impede motion in the opposite direction. The roller clutches are pressed over two ⅛inch 316 shoulder screws 2200. One of the roller clutches 2300 is movable adjusting for different tube diameters while the second roller 2400 is typically fixed in place. The mechanism for the adjustment is not shown in the figure but can exist as a simple nut assembly where the tightening holds the adjustable holder fixed in position. FIG. 5 also shows a vertical washer between separate rollers to keep the plastic pump tubing from drifting off the roller.

Figure 6:
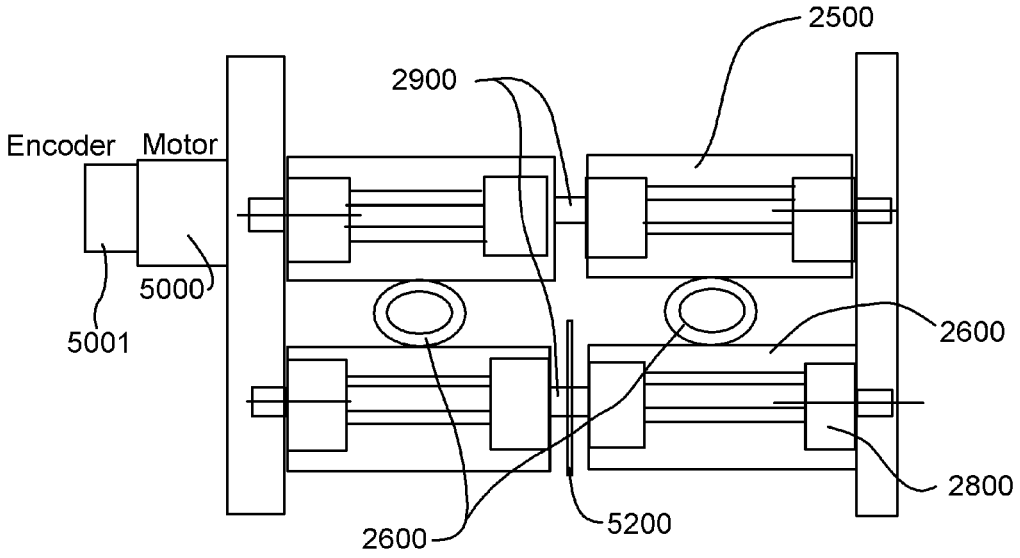
FIG. 6 shows independent holders used to secure two tubes using horizontal roller clutches.

FIG. 6 shows a vertical orientation 2500 with multiple tubes 2600. Each tube can be held independently as shown by the sharp knurled devices 2700 with internal roller clutches 2800. The shafts 2900 are mounted to each roller clutch and each shaft is fixed in place by the pump frame. An optional motor 5000 and optional shaft encoder 5001 is shown providing force to the roller. As previously stated a negator spring may be used in place of a motor. Output from the shaft encoder can be returned to a processor so that tube elongation and tube indexing may be tracked. An optional washer 5002 may be placed between the rollers to prevent tubing drift from one roller to another.

Figure 7A:
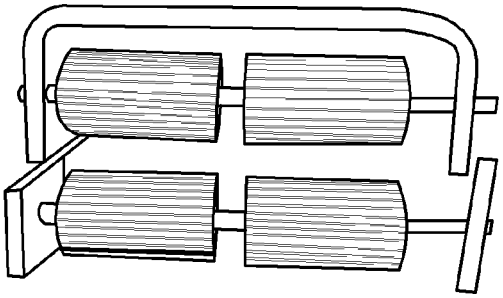
FIG. 7A shows a roller having longitudinal teeth.

FIG. 7A shows a side view of a stepped roller for better grip on the tubing. This type of roller has elongated grooves or steps on its outer surface.

Figure 7B:
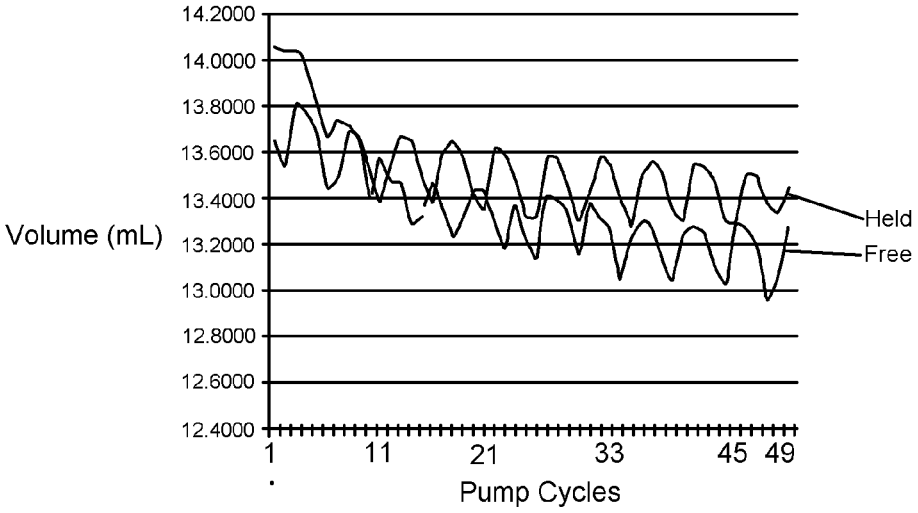
FIG. 7B shows graphically the difference between held and free tube holding.

FIG. 7B shows an elongation graph of a tube that is not held and one that is held. It can be seen that the held curve results in a faster settling and improvement of accuracy. Dispense has been recoded using a Sartoris BP 121S (4) place scale for each volume of water. The "held" data represents the gear rollers compensating for each cycle of tube extrusion. The "free" data represents the "y" tubing mounted on posts.

Figure 8:
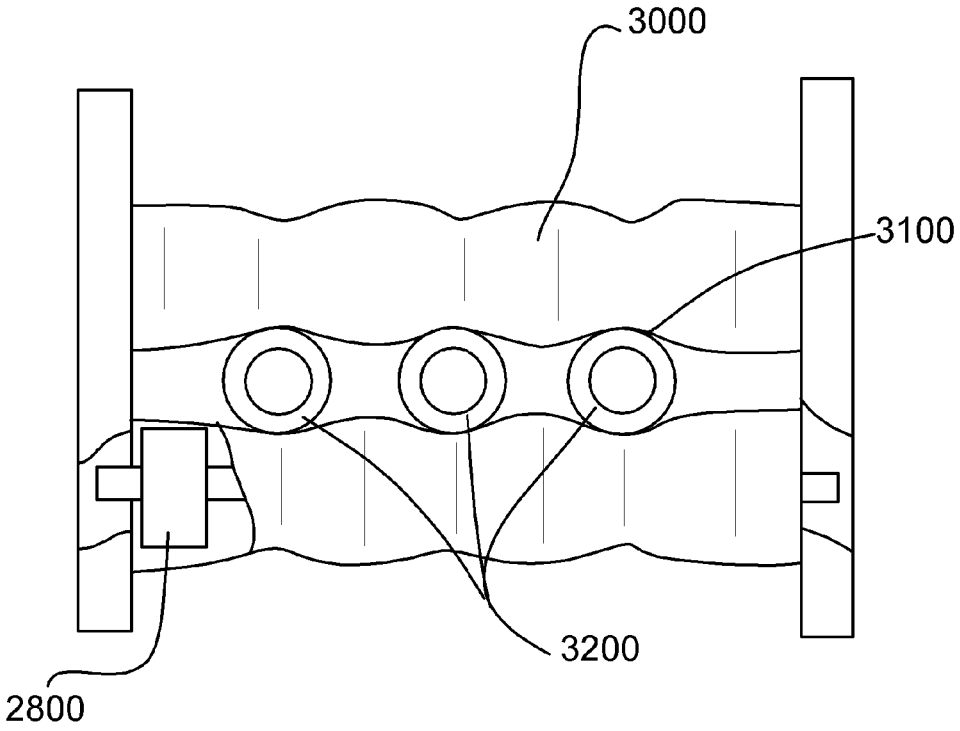
FIG. 8 is a perspective top view of the invention using concave longitudinal rollers.

Shown in FIG. 8 is a multiple tube holding member 3000 where the sharp knurled 3100, hard coated aluminum rollers support three tubes 3200 using concave surfaces in the rollers that match the center each tube. The holding devices can be one complete system or can be made of several tube holders. The concave rollers cause each plastic pump tube to stay aligned with the correct location on the roller. A roller may have one or more concave regions.

Figure 9:
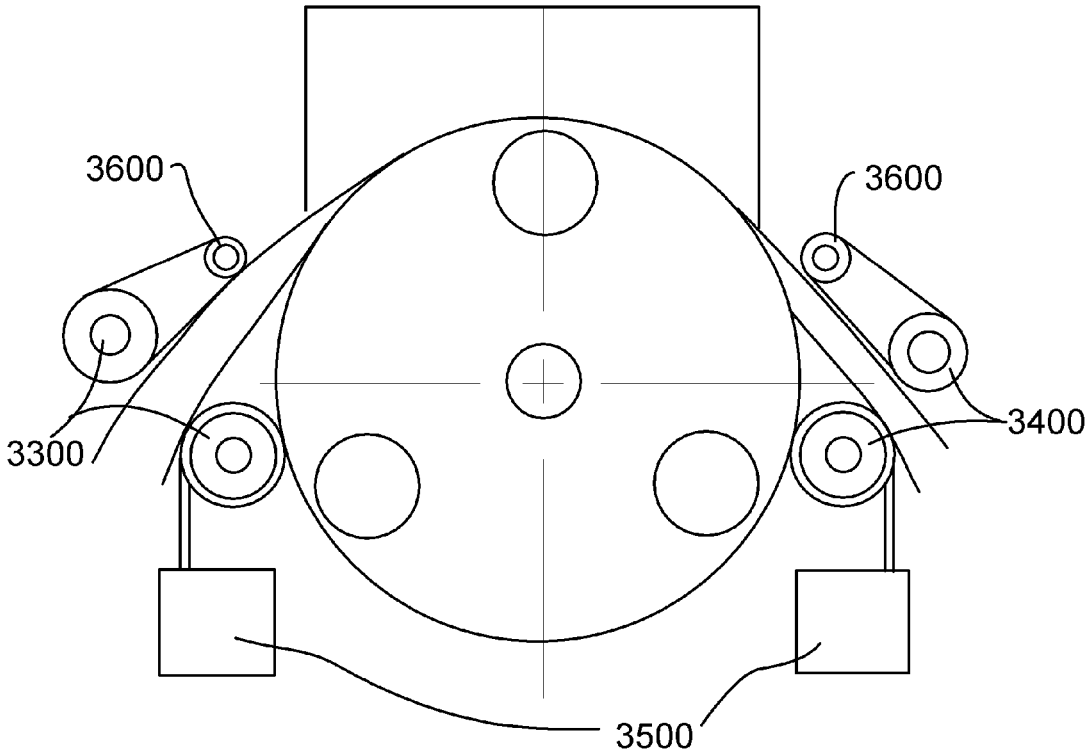
FIG. 9 show negator springs added to provide forces for small tubes.

Shown in FIG. 9 is a set of tube holders at the input 3300 and output 3400 of the pump. A negator spring 3500 is coupled to the lower sharp knurled rollers in opposite directions for the input and output rollers. The top rollers may optionally not have roller clutches, but rather have just conventional roller bearings that impart a downward force using a torsional spring at pivot point 3600. The torsional springs are in the opposite directions for the input and output rollers. The input side of the pump device can also be replaced by a fixed post as long as the output side is as shown in 3400.

Several descriptions and illustrations have been presented to aid in understanding the present invention. One with skill in the art will realize that numerous changes and variations may be made without departing from the spirit of the invention. Each of these changes and variations is within the scope of the present invention.

We claim:

1. A peristaltic pump tube holding system that allows tube elongation but prevents tubes from moving backwards comprising:

a frame holding a peristaltic pump having an input and output;

a pair of substantially cylindrical rollers on roller clutches mounted on said frame, said rollers having longitudinal teeth and positioned to cooperate with said peristaltic pump by clamping a peristaltic pump tube between them;

said pair of substantially cylindrical rollers on roller clutches being located at the input or output of the pump;

the roller clutches existing in a pair where a top clutch is orientated so that tube elongation can occur, and a lower clutch also oriented so that tube elongation can occur, the upper and lower roller clutches being mounted in opposite directions;

the roller clutches enabling tube elongation when the pump operates in a forward direction, but holding, and not allowing elongation, when the pump is operated in a reverse direction for drip retention;

at least one of said rollers on roller clutches being attached to a negator spring located in a string pot, said negator spring assisting in providing force between the rollers for small tubing to assist in elongation;

the rollers having at least one concave region on an outer surface so that the peristaltic pump tube or tubes center or take predetermined positions between the rollers;

at least one of said rollers on roller clutches being attached to a motor providing force between the rollers.

2. The peristaltic pump tube holding system of claim 1 adapted to be used with either rotary or linear types of peristaltic pump systems.

3. The peristaltic pump tube holding system of claim 1 wherein the motor is positioned to advance the peristaltic pump tube into the rollers, said motor having an encoder that monitors the tube elongation and allows metering the tubing during indexing.

4. The peristaltic pump tube holding system of claim 1 further comprising a peristaltic pump output tubing holder having two output rollers with bearings adapted to move only in one direction wherein, the peristaltic pump tube is prevented from moving back into the pump after elongation, said output rollers each having a stair-stepped surface.

5. A peristaltic pump tube holding system that allows tube elongation but prevents tubes from moving backwards comprising:

a frame holding a peristaltic pump having an input and output;

a pair of substantially cylindrical rollers on roller clutches mounted on said frame, said rollers having longitudinal teeth and positioned to cooperate with said peristaltic pump by clamping a peristaltic pump tube between them;

said pair of substantially cylindrical rollers on roller clutches being located at the input or output of the pump;

the roller clutches existing in a pair where an output top clutch is orientated so that tube elongation can occur, and a lower clutch also oriented so that tube elongation can occur, the upper and lower roller clutches being mounted in opposite directions;

the roller clutches enabling tube elongation when the pump operates in a forward direction, but holding, and not allowing elongation, when the pump is operated in reverse for drip retention;

at least one of said rollers on roller clutches being attached to a negator spring located in a string pot, said negator spring assisting in providing force between the rollers for small tubing to assist in elongation;

the rollers having at least one concave region on an outer surface so that said peristaltic pump tube centers between said rollers.

* * * * *